United States Patent [19]

Anderson

[11] 4,074,813

[45] Feb. 21, 1978

[54] TELESCOPIC DRAFT GEAR

[75] Inventor: David G. Anderson, Chesterton, Ind.

[73] Assignee: Miner Enterprises, Inc., Chicago, Ill.

[21] Appl. No.: 732,910

[22] Filed: Oct. 15, 1976

[51] Int. Cl.[2] ..... B61G 11/14

[52] U.S. Cl. ..... 213/24; 213/32 A; 213/34

[58] Field of Search ..... 213/22–26, 213/31, 32 R, 32 A, 32 B, 32 C, 34, 35, 36

[56] References Cited

U.S. PATENT DOCUMENTS

| | | | |
|---|---|---|---|
| 1,562,783 | 11/1925 | O'Connor | 213/34 |
| 1,693,816 | 12/1928 | O'Connor | 213/24 |
| 1,741,648 | 12/1929 | O'Connor | 213/24 |
| 1,877,329 | 9/1932 | Johnson | 213/24 |
| 3,202,300 | 8/1965 | Holm et al. | 213/32 R |

*Primary Examiner*—Trygve M. Blix
*Assistant Examiner*—Stuart M. Goldstein
*Attorney, Agent, or Firm*—Darbo & Vandenburgh

[57] ABSTRACT

A hollow plunger extends into the cavity of the draft gear body. The inner end of the plunger is expansible. One or more wedges are held by the body adjacent the inner end of the plunger, and shoes are positioned between the wedge(s) and the inner side of the inner end of the plunger. Spring elements positioned within the plunger are in compression between the outer end of the plunger and the shoes. When the plunger is forced into the body the shoes are wedged outwardly against the expansible portions of the plunger which in turn are forced into contact with the body. There may be one or a plurality of successive stages of wedges and shoes.

12 Claims, 5 Drawing Figures

TELESCOPIC DRAFT GEAR

BACKGROUND AND SUMMARY OF THE INVENTION

Conventionally, draft gears employ a combination of springs and friction elements to absorb shocks that occur as a result of pulling and buffing forces applied to the railroad car coupler and reduce the magnitude of those shocks as applied to the car frame, body and content. Conventional draft gears of this type position the spring within the draft gear body, with the friction elements being positioned adjacent the open end of that body. These friction elements act between the inner wall of the body at the open end to provide a frictional force absorption related to the magnitude of the applied force.

In the present invention a plunger is telescoped into the draft gear body, the spring elements are placed within the plunger and the friction elements are deep within the body cavity (as compared to the prior art practices) to act on the inside of the walls of the plunger. A number of advantages over the prior art practices which incorporate spring and friction elements are thereby achieved, which advantages include: Since the plunger telescopes within the body it is guided by the body both at the open end of the body and deep within the body cavity. This provides stabilization and reduces the tendency of the plunger to cock, i.e., becomes misaligned, with respect to the body. The shock absorbing elements are deep within the body cavity and are thus protected against deleterious action which can occur when those elements are exposed. The construction permits friction to be developed not only between the shoes acting on the inner walls of the plunger as a result of the action of the fixed wedges, but also between the outer walls of the plunger and the inner walls of the body. This enhances the possibility for a shorter draft gear since the amount of force reaction required to be provided by the spring element can be reduced. The possibility of shortening the draft gear also is enhanced in that in some embodiments the friction elements can surround the spring elements, rather than in a linear series as is the case with prior art practices. The friction elements may also be cascaded to obtain a multiplication of the force-absorption which the friction elements provide. Embodiments may be made using tubing rather than castings to thereby achieve manufacturing cost reduction of comparable strength units.

In such embodiments the body length is not a limiting factor to the spring length as is the case in prior art devices. Using the present invention, draft gears can be provided which having a long travel (extent of movement upon impact).

Further objects and advantages will become apparent from the following description and attached drawings.

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
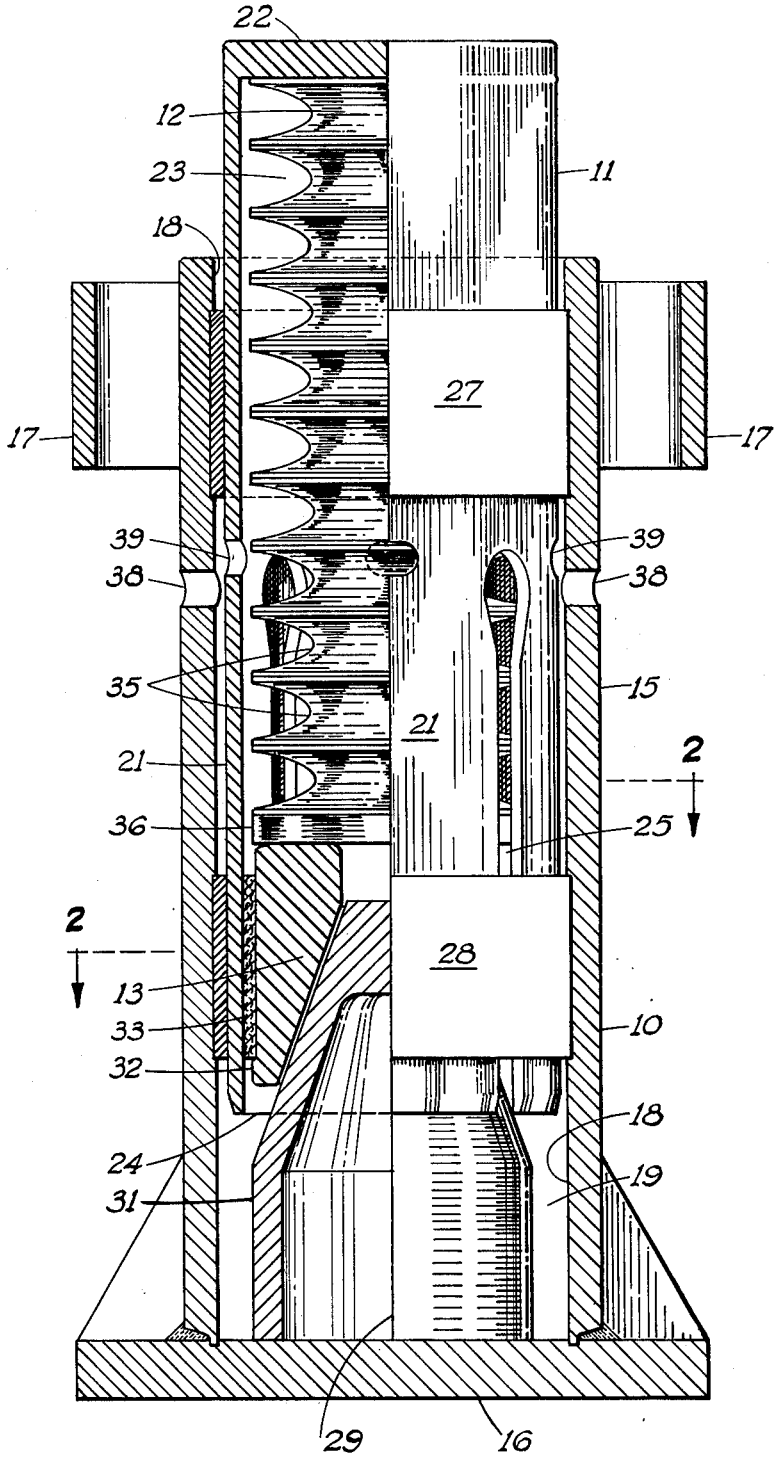
FIG. 1 is a sectional view of an embodiment of the invention, with the right half being a view immediately inside of the body wall and the left half being a section along the longitudinal axis.
Figure 2:
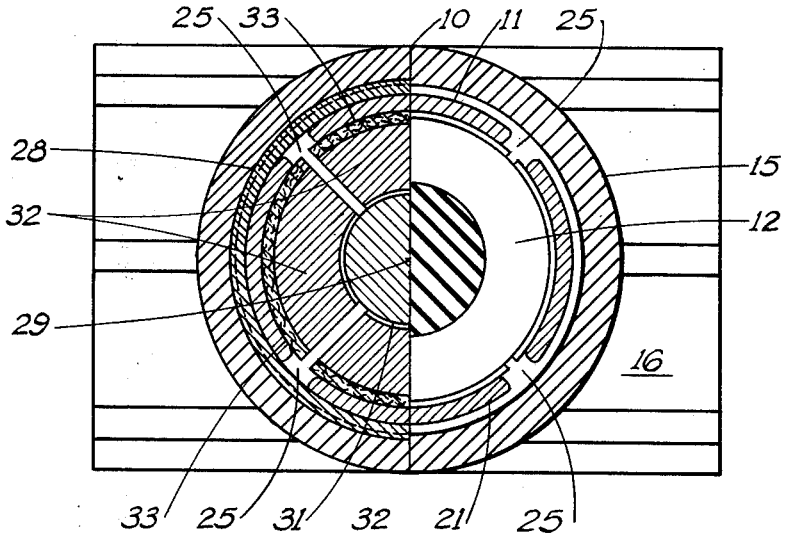
FIG. 2 is a section taken at line 2—2 of FIG. 1.

The embodiment of FIGS. 1 and 2 comprises a draft gear body, generally 10, a plunger, generally 11, telescopically received within the body, spring elements, generally 12, positioned within the plunger and friction elements, generally 13. The body comprises a cylindrical tube 15 welded to an end plate 16. Lugs 17 are welded to the tube adjacent the other end thereof to position the draft gear in the center sill pocket of a railroad car or to accommodate a short yoke of a type well known in the art as well as the standard type of yoke which extends around the rear wall 16 in the usual manner. The tube has an inner wall 18 which defines an internal cavity 19 closed at one end by the inner face of plate 16 and open at the other end to receive the plunger 11.

Plunger 11 has a circular outer wall 21 and a cylindrical outer end wall 22 which closes the outer end of the internal opening 23. Opening 23 extends to the inner end 24 of the plunger. Extending from the inner end of the plunger are one or more slots 25 in wall 21, four slots 25 being shown, to permit wall 21 to flex radially in the area adjacent the end 24.

A friction bearing 27 is provided on wall 18 adjacent the open end of the housing and may be locked in a recess, as shown. Similarly, a friction bearing 28 is provided on wall 18 adjacent the closed end of cavity 19 or may be locked in a recess, as shown. The material of these friction bearings is a brake shoe type material. Plunger 11 reciprocates in these bearings along the longitudinal axis 29.

The friction elements include a wedge 31 abutting end plate 16. This wedge is in the form of a truncated cone coaxial with longitudinal axis 29, but could comprise a plurality of plane faces generally in the form of a pyramid. There are a plurality of shoes 32, four in the illustrated embodiment, having inner faces which mate with, and ride on, wedge 31. The outer faces of the shoes have a layer 33 of brake shoe type material bonded thereto. The spring elements 12 comprises one or more and preferably a series of elastomeric spring discs 35. One end of this series bears against end wall 22 of the plunger and the other end bears against a pressure or follower plate 36 which in turn bears or rides on shoes 32.

As a force is applied to the draft gear between end wall 22 of the plunger and plate 16 of the housing, the plunger moves (additionally telescopes) into the housing. This movement is resisted by the spring elements 12 and by the friction which occurs (1) between the shoes 32 and the wall 21 of the plunger, and (2) between the wall 21 of the plunger and the wall 15 of the housing (the friction bearings 28 and 33 being considered to be a part of the respective components comprising the friction elements). The more that the plunger telescopes into the housing, the greater will be the force developed by wedge 31 and shoes 32 in a radial direction thus increasing the frictional resistance to closure. As the force applied between the end of the plunger and the end of the housing is relieved, the plunger will be returned toward its original position by the action of spring 12. Obviously, one or more coil springs can be substituted for the series of elastomeric discs 35 and the pressure or follower plate 36 may or may not be necessary depending on design.

Openings 38 in the housing and 39 in the plunger are used for precompression of the draft gear to facilitate its insertion into its pocket in the railway car. After the draft gear is assembled and tested, the plunger 11 is pressed into the housing until openings 38 and 39 are in alignment. A frangible pin, not shown, is then inserted through the aligned opening. This pin is sufficient to hold the draft gear in precompressed condition. After the draft gear is inserted into the railway car and the railway car is put into service. the initial shock or two applied to the draft gear by the forces normally present in the operation of a train, results in the fracture of the pin. This allows the plunger to move out under the influence of the spring 12 and the draft gear thereafter will function in the normal manner.

Figure 4:
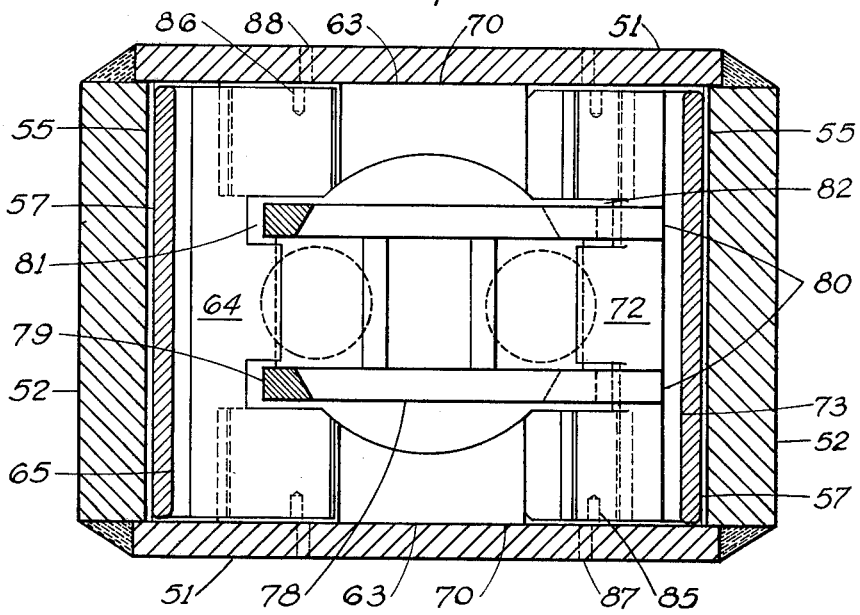
FIG. 4 is a section taken at line 4—4 of FIG. 3.
Figure 3:
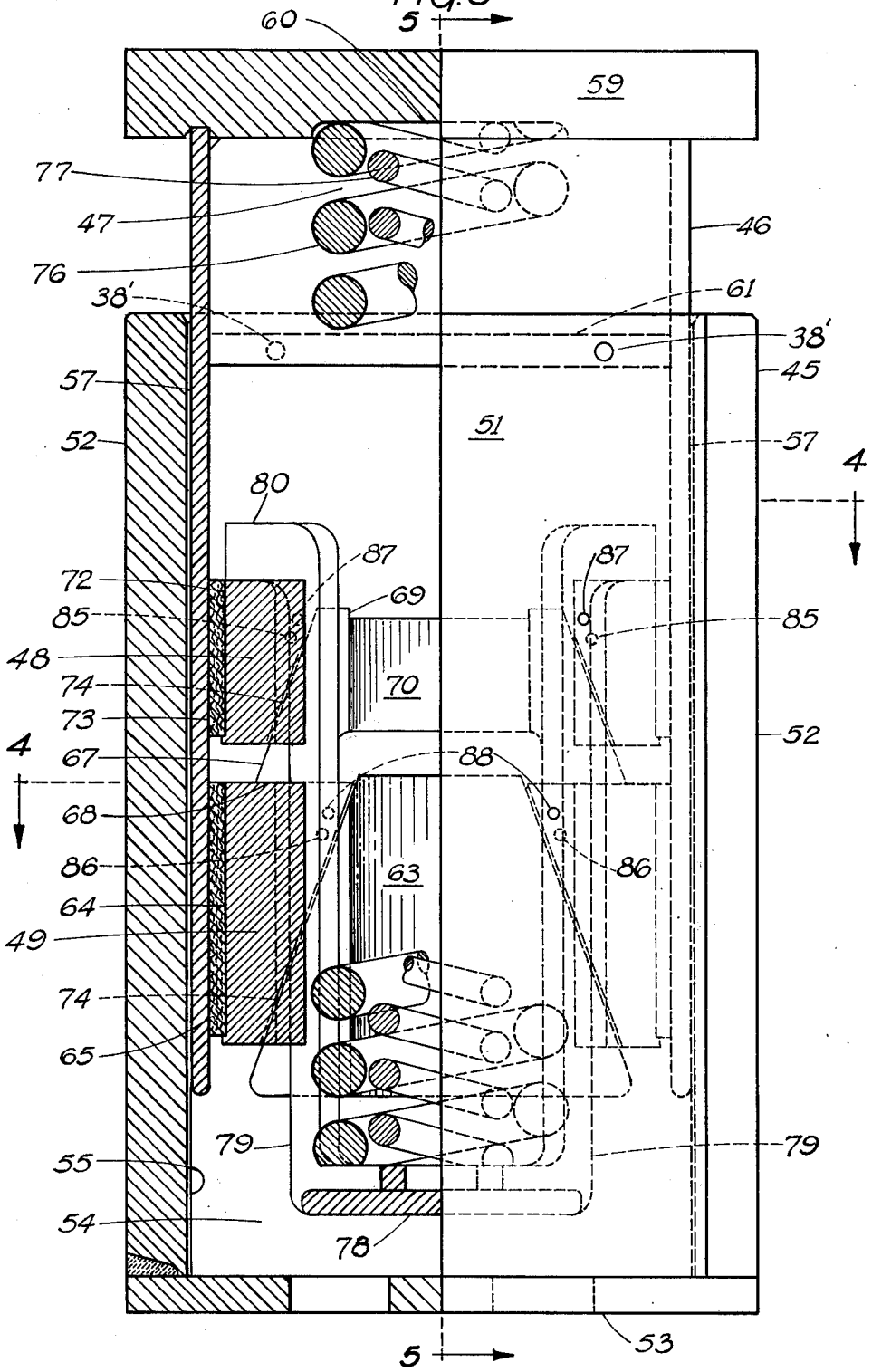
FIG. 3 is a view of a second embodiment of the invention, with the right half being in elevation and the left half being a section along the longitudinal axis.
Figure 5:
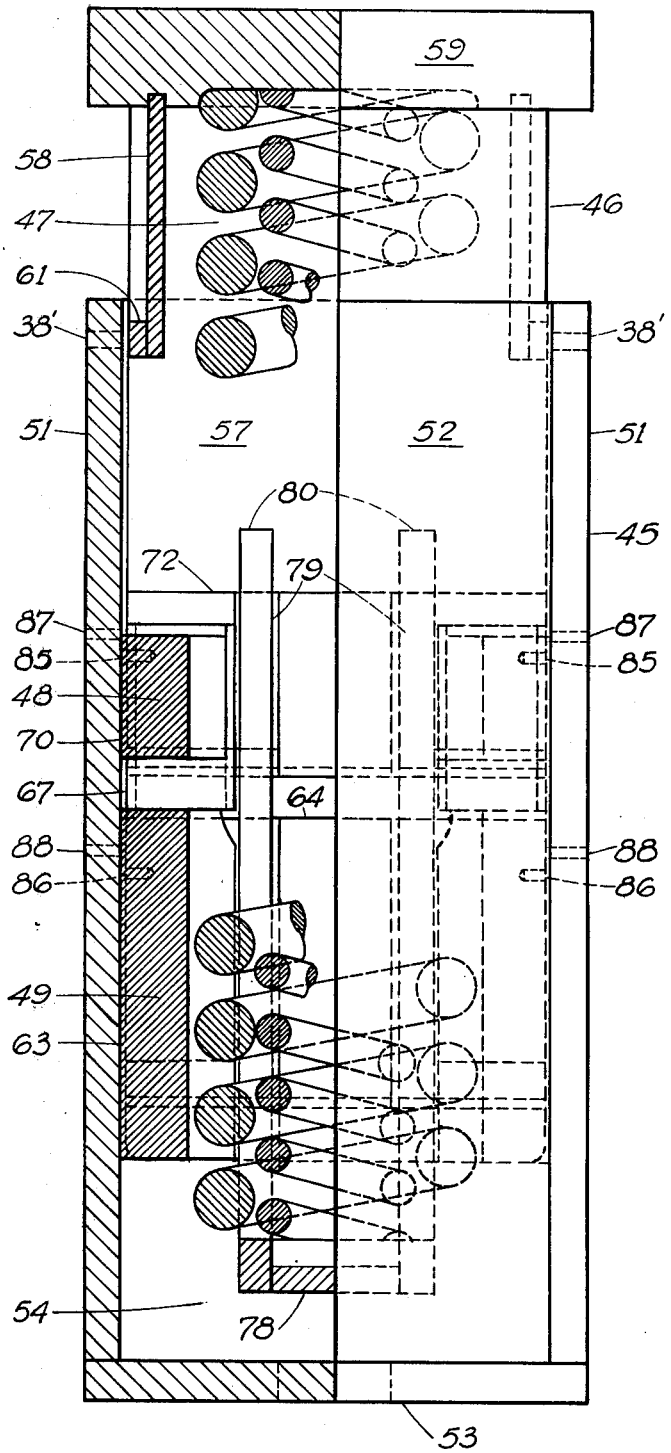
FIG. 5 is a view taken at line 5—5 of FIG. 3, with the right half being in elevation and the left half being a section along the longitudinal axis.

The embodiment of FIGS. 3–5 employ a housing, generally 45, and a plunger, generally 46, which are rectangular in cross-sectional configuration. Within the housing and plunger are spring elements, generally 47, a first stage of friction elements, generally 48, and a second stage of friction elements, generally 49.

The housing comprises two relatively wide side walls 51, two relatively narrow side walls 52, and an end wall 53. These walls define a housing cavity 54 having an open end through which the plunger 46 extends. The narrow side walls 52 include a facing 55 of Dacron reinforced phenolic with Teflon fibers embedded therein.

The plunger 46 comprises a pair of relatively narrow, relatively long side walls 57, a pair of relatively wide, relatively short side walls 58 and an outer end wall 59. End wall 59 has an internal recess 60 to provide a centering seat for the spring elements 47. The plunger walls 57 bear against the Dacron facing 55 of housing walls 52. Plunger walls 58 are set back from housing walls 51 with a metal spacer 61, secured to plunger walls 58, closing the gap therebetween. In the area inwardly of the spacer 61, the plunger walls 57 can flex toward and away from the housing walls 52.

The second stage 49 of the friction elements includes a pair of wedges 63 each being secured to a respective one of the housing walls 51. Adjacent each of the plunger walls 57 is a second stage shoe 64. Each shoe has one inclined face that rides on an inclined face of one of wedges 63 and a second face that rides on an inclined face of the other of wedges 63, with the shoes bridging the gap between the wedges. The outer face of each shoe is formed by a pad 65 of brake shoe type material.

The first stage 48 of the friction elements includes four floating wedges 67. These four wedges are at the corners of a rectangle transverse to the axis of the housing and have ends 68 which bear against the top (as viewed in the drawings) of the shoes 64. The wedges also have an alignment face 69 which bears against and slides along a spacer 70. The two spacers 70 are secured to walls 51 of the housing 45. The spacers allow the wedge 67 to move vertically (as viewed in FIG. 3 for example), but prevents it from moving in the direction of the other wedge in contact with the spacer.

In juxtaposition to each of plunger walls 57 is a first stage shoe 72. This shoe includes an outer pad 73 of brake shoe type material, which pad actually contacts wall 57 of the plunger. Each shoe 72 bridges the gap between two of wedges 67. The face of the shoe riding on each wedge may have a facing 74 of Dacron reinforced phenolic with Teflon fibers, or similar controlled friction material. A corresponding facing 74 may be employed on the shoes 64 of the second stage.

The spring elements 47 include two concentric springs 76 and 77 nested one within the other and a spring hanger in which the springs are seated. The spring hanger comprises a base 78, four arms 79 each having a finger 80 on the end thereof. The arms 79 extend through slots 81 in shoes 64 and slots 82 in shoes 72. The fingers 80 bear on the top (as viewed in the drawings) of the shoes 72. Thus the springs 76 and 77 are in compression between end wall 59 of the plunger and the face of shoes 72 most closely adjacent that end wall.

When a force, pull or buffing, is applied to the ends of the draft gear that force acts to drive the plunger 46 into the housing 45. This causes a compression of springs 76, 77 and the force of the spring is applied through the spring hanger to the first stage shoes 72. Shoes 72 act both to apply a frictional force to walls 57 of the plunger and, through wedges 67, apply a longitudinal force to second stage shoes 64. That longitudinal force applied to shoes 64 likewise causes those shoes to frictionally engage the plunger.

The number of stages of frictional elements employed in an embodiment such as that of FIGS. 3–5 can be selected at the option of the manufacturer. Only a single stage could be employed with the spring hanger fingers 80 bearing directly on the shoes 64. Alternatively, the hanger could be omitted and springs, including an elastomer spring, could fill the space from end wall 59 to the top of shoes 64. Alternatively, a third stage, etc., could be added in series with the two stages illustrated.

Holes 85 and 86 in shoes 72 and 64 and holes 87 and 88 in the housing are employed to pin the shoe away from the end wall for assembly of the plunger. Alternative shoe "hold back" during assembly could be a fiber line to tie back. Holes 38' are used in conjunction with holes (not shown) in the plunger 46 to receive pins (not shown) to hold the assembly precompressed as previously described in connection with the embodiment of FIGS. 1 and 2.

In the embodiment illustrated in FIGS. 3–5, there are actually two wedge contacting faces per shoe with the complete shoe bridging the gap between the wedge contacting faces. It will be apparent to those in the art that such bridge (e.g., the central portion of shoe 64 as viewed in FIG. 4) could be omitted so that at each corner there was a separate shoe corresponding to an individual wedge face.

I claim:

1. In a railroad car draft gear including a housing having inner wall means defining a cavity therein extending along a longitudinal axis, a plunger extending at least partially into the cavity and mounted for reciprocal movement with respect to the housing as forces are applied to the two spaced ends of the plunger and housing respectively, and a device, including friction elements and spring elements, within the cavity for resiliently and frictionally resisting forces acting on the draft gear to force the plunger into the housing, the improvement comprising:

said plunger having an external end and an internal end and including two opposed wall portions adjacent the internal end and in contact respectively with the wall means of the housing, said plunger defining a pocket from the internal end, between said wall portions and toward the external end, said wall portions at said internal end being separate so that they can be flexed toward and away from the wall means, said plunger being guided by said wall means for said movement along said axis;

said device including wedge means adjacent the base of the cavity and between said wall portions, and floating shoe means between the wedge means and the wall portions, said spring elements being in the pocket and in compression between the shoe means and the plunger, said wedge means and shoe means being positioned so that increased compressive force of the spring means urges the shoes against the wall portions of the plunger.

2. In a draft gear as set forth in claim 1, wherein the cavity is cylindrical, the plunger is generally annular with a plurality of slots extending from said inner end towards the outer end, and said wedge means is generally conical about said axis.

3. In a draft gear as set forth in claim 1, wherein said cavity is rectangular in cross-section and said wall means comprises two pair of walls, the walls of each pair being on opposite sides of said axis, said wall portions comprise two walls each of which is in juxtaposition to a respective wall of one of said pairs.

4. In a draft gear as set forth in claim 3, wherein said wedge means and said shoe means are in juxtaposition to the walls of the second pair of walls with a space therebetween, and said device includes a spring hanger in said space and having one end engaging the shoe means for applying a force to said shoe means in the direction toward the base of the cavity and a second end adjacent the base of the cavity.

5. In a draft gear as set forth in claim 4, wherein said device comprises two stages of wedge means and shoe means;

the wedge means of the second stage comprising two wedges secured to the housing and adjacent the base of the cavity, the shoe means of the second stage comprising two shoes in contact with said two wedges and positioned between said wedges and the wall portions;

the wedge means of the first stage being movable in an axial direction and being between said two shoes and the open end of the housing and in contact with said two shoes, the shoe means of the first stage being between the movable wedge means and the wall portions, said one end of the spring hanger engaging said shoe means of the first stage.

6. In a draft gear as set forth in claim 1, wherein said device comprises two stages of wedge means and shoe means;

the wedge means of the second stage comprising two wedges secured to the housing and adjacent the base of the cavity, the shoe means of the second stage comprising two shoes in contact with said two wedges and positioned between said wedges and the wall portions;

the wedge means of the first stage being movable in an axial direction and being between said two shoes and the open end of the housing and in contact with said two shoes, the shoe means of the first stage being between the movable wedge means and the wall portions, said spring elements including means engaging said shoe means of the first stage.

7. In a draft gear as set forth in claim 6, wherein said wedge means of the first stage comprises four wedges positioned approximately at the four corners of a rectangle about said axis, and said device includes guides secured to said walls of said other pair and engaging said four wedges for guiding the movement of the four wedges longitudinally in said cavity.

8. In a draft gear as set forth in claim 1, including a brake shoe type material between the shoe means and the plunger, secured to one of the two and contacting the other of the two.

9. In a draft gear as set forth in claim 8, including brake shoe type material between the wall portions and the housing, secured to one of the two and contacting the other of the two.

10. In a railway draft gear including a housing having inner wall means defining a cavity therein extending along a longitudinal axis and having an open end and a substantially closed end, a plunger extending at least partially into the cavity and mounted for reciprocal movement with respect to the housing as forces are applied to the two spaced ends of the plunger and housing respectively, and a device, including friction elements and spring elements, within the cavity for resiliently and frictionally resisting forces acting on the draft gear to force the plunger into the housing, said draft gear being characterized by:

said plunger being guided in said housing for movement along said longitudinal axis both at a location adjacent the open end of the cavity and at a location adjacent the closed end of the cavity thereby reducing the tendency of the plunger to cock with respect to the housing, that is, to become misaligned with respect to said axis; and said friction elements being at least in part positioned adjacent the closed end of the cavity.

11. A draft gear as set forth in claim 10, wherein said plunger has an internal opening at the inner end with inner walls thereabout, and said friction means bears against said inner walls.

12. In a draft gear as set forth in claim 1, wherein the wedge means is affixed to said housing and is immovably held thereby

* * * * *